US006439321B1

(12) United States Patent
Gillis et al.

(10) Patent No.: US 6,439,321 B1
(45) Date of Patent: Aug. 27, 2002

(54) PISTON ACTUATOR ASSEMBLY FOR AN ORIENTING DEVICE

(75) Inventors: Ian Gillis; Daniel P. Lupien, both of Alberta (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 09/561,943

(22) Filed: May 1, 2000

(30) Foreign Application Priority Data

Apr. 28, 2000 (CA) ..... 2307514

(51) Int. Cl.[7] ..... E21B 7/08; E21B 23/12; E21B 34/10

(52) U.S. Cl. ..... 175/73; 166/117.5; 166/155; 166/383

(58) Field of Search ..... 166/50, 117.5, 166/153, 155, 313, 332.1, 381, 383; 175/61, 73, 232

(56) References Cited

U.S. PATENT DOCUMENTS 3,743,034 A * 7/1973 Bradley ..... 175/61
4,286,657 A * 9/1981 Kohn ..... 166/117.5
4,655,299 A * 4/1987 Schoeffler ..... 175/38
4,811,798 A * 3/1989 Falgout, Sr. et al. ..... 175/73
4,895,214 A * 1/1990 Schoeffler ..... 175/38
5,215,151 A 6/1993 Smith et al.
5,259,467 A * 11/1993 Schoeffler ..... 175/38
5,311,952 A 5/1994 Eddison et al.
5,316,094 A 5/1994 Pringle
5,421,420 A * 6/1995 Malone et al. ..... 175/61
5,617,926 A * 4/1997 Eddison et al. ..... 175/61
5,730,224 A * 3/1998 Williamson et al. ..... 166/386
5,894,896 A 4/1999 Smith et al.
6,047,784 A * 4/2000 Dorel ..... 175/61
6,109,372 A * 8/2000 Dorel et al. ..... 175/61

OTHER PUBLICATIONS

Sperry–Sun Drilling Services Technology Update, Winter 1995 entitled "Coiled Tubing BHA Orienter for Directional and Horizontal Drilling" (2 pages).

Sperry–Sun Drilling Services, Inc., Brochure entitled "Sourcebook", dated 1996, p. 56 ("Coiled Tubing BHA Orienter") (1 page).

Sperry–Sun Drilling Services, Operations Manual for "Adjustable Guage Stabilizer (AGS)" dated 1997 (62 pages).

* cited by examiner

*Primary Examiner*—David Bagnell
*Assistant Examiner*—Jennifer H Gay
(74) *Attorney, Agent, or Firm*—Terrence N. Kuharchuk; William Shull; Michael D. McCully

(57) ABSTRACT

An actuator for an orienting device for orienting a borehole apparatus in a borehole and an orienting device comprised of the actuator, wherein the orienting device is comprised of an orienting mechanism which is actuated by longitudinal movement. The actuator is comprised of a housing having a first end and a second end and a fluid passageway extending through the housing from the first end to the second end. Further, a longitudinally reciprocable piston, positioned within and providing a first partial obstruction of the fluid passageway, engages with the orienting mechanism such that longitudinal movement of the piston actuates the orienting mechanism. Finally, a flow restrictor, positioned within and providing a second partial obstruction of the fluid passageway, is associated with the piston such that the first partial obstruction is longitudinally aligned with the second partial obstruction for a portion of a longitudinal range of travel of the piston to provide a combined obstruction of the fluid passageway.

14 Claims, 5 Drawing Sheets

PISTON ACTUATOR ASSEMBLY FOR AN ORIENTING DEVICE

FIELD OF INVENTION

The present invention relates to an actuator for an orienting device for orienting a borehole apparatus in a borehole and to an orienting device comprised of the actuator. The orienting device includes an orienting mechanism actuated by longitudinal movement.

BACKGROUND OF INVENTION

Directional drilling involves controlling the direction of a borehole as it is being drilled in order to drill along a predetermined path. It is often necessary to adjust the direction of the borehole frequently while directional drilling, either to accommodate a planned change in direction or to compensate for unintended or unwanted deflection of the borehole.

Directional drilling may involve the use of a drilling bit actuated by a downhole motor connected with the drill string and which is powered by the circulation of fluid, such as drilling mud, supplied from the surface. Typically, the downhole motor includes a bent housing or bent sub so that the resulting path drilled by the drilling bit is slightly curved. Further, the downhole motor actuates the drilling bit relative to the bent housing or bent sub and the drill string. In other words, the drill string itself need not be moved or rotated during the drilling operation in order to actuate the drilling bit.

The drilling operation will be intermittently interrupted in order to ascertain the path of the borehole in relation to the desired predetermined path. In the event that correction or adjustment of the path is required, the drill string may be rotated from the surface in order to rotate the bent motor housing or the bent sub downhole. This is possible due to the relatively rigid nature of a conventional drill string. Thus, rotation of the drill string from the surface orients the bent housing or bent sub in the desired direction to adjust the borehole towards the desired predetermined path.

However, coiled tubing may also be used for drilling operations such that the drill string is typically comprised of a single length of relatively flexible tubing which is inserted into the borehole. Various downhole tools, including a downhole motor and drilling bit, may be connected with the downhole end of the coiled tubing string. However, as a result of the nature of coiled tubing and the manner by which it is run into the borehole, it is not possible to rotate the bent housing or bent sub downhole, in order to adjust the direction of the borehole, by rotating the coiled tubing string from the surface.

As a result, various orienting devices or orienting subs have been developed for connection between the coiled tubing string and the bent housing or bent sub. These orienting devices are provided to rotate the bent housing or bent sub relative to the coiled tubing string in order to adjust the direction of the borehole. Typically, the orienting device rotates the bent housing or bent sub through a selected incremental amount in order to fix the angular orientation of the bend point in the bent housing or bent sub in relation to the axis of the borehole so that the borehole can be drilled along the predetermined path.

Several of these orienting devices are comprised of hydraulic systems connected to the surface for supply of the hydraulic fluid to actuate the device. For instance, U.S. Pat. No. 5,316,094 issued May 31, 1994 to Pringle and U.S. Pat. No. 5,894,896 issued Apr. 20, 1999 to Smith et. al. both describe an orienting device for use with coiled tubing for rotationally orientating a well tool to the proper direction in the well bore. The orienting device is comprised of a body or tubular housing, a mandrel rotatable within the body for providing rotation to the well tool and a hydraulic piston slidably positioned in the annulus between the body and the mandrel. The orienting device provides for the rotation of the mandrel within the body or housing in response to the longitudinal movement of the piston in the annulus.

In Pringle, a hydraulic control line is connected to a first side of the piston for moving the piston longitudinally in a first direction. A spring is provided against the second side of the piston for moving the piston longitudinally in an opposed second direction. The hydraulic control line is provided from the surface, through the coiled tubing to the orienting device to provide the hydraulic control fluid for operating the orienting device. Similarly, in Smith et. al., a flow path is provided for the selective delivery of pressurized hydraulic fluid to either side of the piston so that the mandrel may be rotated in either a clockwise or a counterclockwise direction or to both sides of the piston equally to maintain the piston in a fixed annular orientation. Further, the flow path is supplied with hydraulic fluid through two hydraulic lines which transfer fluid from the surface to the device with the lines alternating in function as either supply, relief or return lines.

Given the inherent disadvantages associated with the use of a hydraulic system including hydraulic lines from the surface for actuating the orienting device, various further orienting devices have been developed which are actuated by the fluid being conducted through the drill string, such as the drilling mud. For instance, U.S. Pat. No. 5,215,151 issued Jun. 1, 1993 to Smith et. al. and Sperry-Sun Drilling Services Technology Update, Winter 1995, entitled "Coiled Tubing BHA Orienter for Directional and Horizontal Drilling" each describe an orienting device or orienting sub which is actuated by the flow of the drilling mud through the device.

These orienting devices are located in the bottom hole assembly above the motor and are actuated by the pressure drop across, or the mud flow rate through, the bottom hole assembly including the orienting device. In particular, a flow path is provided through the orienting device for the circulation of the drilling fluid relatively unrestricted therethrough at all times. Further, the device is comprised of a drive piston which is exposed to the drilling fluid as it circulates through the device. When the drilling fluid pumps are on, the flow induced pressure drop acts across the drive piston of the device and drives it downwards against a helical cam, which results in the indexing of an output shaft of the device a predetermined increment of degrees. Upon cessation of the flow, the drive piston is biased by a spring to be driven upwards to reset the orienting device. Thus, the flow through the device may be cycled a desired number of times in order to achieve the desired indexing of the output shaft and the downhole tool connected thereto.

However, there is no positive indication provided to the operator at the surface that the orienting device has in fact cycled or indexed upon pumping the drilling fluid therethrough. Further, given the relatively unrestricted flow of the drilling fluid permitted through the orienting device, it has been found that a relatively high pressure of the drilling fluid is required within the device to act upon the drive piston and move it downwards to index the output shaft. To achieve this necessary actuating pressure, the flow of the drilling fluid through the bottom hole assembly, including the motor, may similarly be excessive resulting in unnecessary wear and potential damage to the bottom hole assembly and the motor.

As a result, the orienting device may be used with a companion device referred to as an equalizer sub. The equalizer sub is positioned in the bottom hole assembly between the orienting device and the motor. The equalizer sub includes a restrictor nozzle which is positioned in the flow path of the drilling fluid to provide a partial restriction to the flow therethrough. More particularly, the restrictor nozzle generates a differential pressure and creates a pressure drop with which to power the orienting device. The restrictor nozzle provides a sufficient back pressure in the orienting device to actuate the drive piston and drive it downwards without the associated increase in the mud flow rate through the motor. Further, the equalizer sub includes a vent port to allow the pressure to equalize between the bottom hole assembly and the borehole annulus when the pump is off, thus permitting the orienting device to be reset by a return spring.

For example, U.S. Pat. No. 5,311,952 issued May 17, 1994 to Eddison et. al. describes a reciprocating mandrel assembly mounted within a housing. A piston is mounted to the upper end of the mandrel assembly, while a nozzle is mounted onto the lower end of the mandrel assembly. The flow path of the drilling fluid is provided through the mandrel assembly from its upper to its lower end. Thus, the nozzle at the lower end provides a partial restriction of the flow path through the orienting device. Accordingly, when the drilling mud is pumped downwardly through the mandrel assembly, a pressure drop is created across the nozzle which generates a downward force on the piston mounted to the upper end of the mandrel assembly and drives the mandrel assembly to a lower position, thus indexing the device an incremental amount. Upon reducing the rate of mud flow through the mandrel assembly, the bias of a spring acts upon the mandrel assembly to return it to its upper position, thus further indexing the device a further incremental amount.

However, although it is advantageous to have a relatively high pressure drop while the bottom hole assembly is orienting, and thus the orienting device is doing the work, it is also advantageous to subsequently decrease the pressure drop to a lesser amount while drilling ahead with the downhole motor. These further orienting devices do not provide for a subsequent decrease in the pressure drop.

In addition, with these further orienting devices there continues to be no positive surface indication that the orienting device has in fact cycled or indexed upon pumping the drilling fluid therethrough. Further, although the restrictor nozzle or equalizer sub provide some protection to the motor against excessive mud flow rates, the surface pumps are often required to work harder to maintain the desired flow rate through the motor as a result of the presence of the restriction. Further, and as a result, particular care must be taken in selecting the amount of the restriction or size of the restrictor nozzle to ensure that the pressure within the drill string, and particularly the coiled tubing, above the orienting device is maintained at acceptable levels.

Thus, there remains a need in the industry for an improved orienting device for orienting a borehole apparatus in a borehole and for an improved actuator for the orienting device. Preferably, the improved actuator and orienting device relatively easily produce a pressure drop necessary to actuate or cycle the orienting device, while minimizing the associated disadvantages as discussed above. Further, the actuator and orienting device preferably cycle upon a relatively lower or lessened continuous pressure drop across the device as compared to other orienting devices, such as those described herein. Finally, there remains a need in the industry for an improved orienting device and for an improved actuator for the orienting device which preferably provide a positive surface indication that the orienting device has cycled.

SUMMARY OF INVENTION

The present invention relates to an actuator for a downhole apparatus or device which is actuated by longitudinal movement. The actuator may be used to actuate any such downhole apparatus or device, however, preferably, the downhole apparatus or device is an orienting device for orienting a borehole apparatus in a borehole.

More particularly, the present invention relates to an actuator for an orienting device for orienting a borehole apparatus in a borehole, wherein the orienting device preferably includes an orienting mechanism actuated by longitudinal movement. Further, the present invention relates to an orienting device comprised of the actuator, wherein the orienting device preferably includes an orienting mechanism actuated by longitudinal movement.

In addition, the actuator and the orienting device are preferably exposed to and actuated by a pressure of a fluid, preferably a fluid being circulated through the orienting device. In the preferred embodiment, the actuator and the orienting device are exposed to and actuated by the pressure of a drilling fluid. Further, the actuator and the orienting device are preferably actuated and cycle upon a relatively lower or reduced pressure of the fluid as compared to other orienting devices, such as those described above.

As well, the actuator and the orienting device of the within invention preferably provide a positive surface indication that the orienting device has fully cycled. In the preferred embodiment, the positive surface indication is provided by a visible or notable change in the pressure drop in the drilling fluid when actuated, which is observable at the surface by the operator.

Thus, in a first aspect of the invention, the invention is comprised of an actuator for an orienting device, wherein the orienting device is comprised of an orienting mechanism which is actuated by longitudinal movement, the actuator comprising:

(a) a housing having a first end and a second end;

(b) a fluid passageway extending through the housing from the first end to the second end;

(c) a longitudinally reciprocable piston positioned within and providing a first partial obstruction of the fluid passageway, for engagement with the orienting mechanism such that longitudinal movement of the piston actuates the orienting mechanism; and (d) a flow restrictor positioned within and providing a second partial obstruction of the fluid passageway, the flow restrictor being associated with the piston such that the first partial obstruction is longitudinally aligned with the second partial obstruction for a portion of a longitudinal range of travel of the piston to provide a combined obstruction of the fluid passageway.

In a second aspect of the invention, the invention is comprised of an orienting device for orienting a borehole apparatus in a borehole, wherein the orienting device is comprised of an orienting mechanism which is actuated by longitudinal movement and an actuator for actuating the orienting mechanism, the actuator comprising:

(a) a housing having a first end and a second end;

(b) a fluid passageway extending through the housing from the first end to the second end;

(c) a longitudinally reciprocable piston positioned within and providing a first partial obstruction of the fluid passageway, for engagement with the orienting mechanism such that longitudinal movement of the piston actuates the orienting mechanism; and (d) a flow restrictor positioned within and providing a second partial obstruction of the fluid passageway, the flow restrictor being associated with the piston such that the first partial obstruction is longitudinally aligned with the second partial obstruction for a portion of a longitudinal range of travel of the piston to provide a combined obstruction of the fluid passageway.

In both the first and second aspects of the invention, the actuator and the orienting device may be used for any application in which the orientation or direction of a borehole apparatus is desired to be controlled or adjusted within the borehole. However, the actuator and the orienting device have particular application for use with coiled tubing. Particularly, the actuator and the orienting device have particular application for coiled tubing drilling for drilling directional and horizontal wells. In this instance, the actuator and the orienting device are preferably included within or comprise a bottom hole assembly connected downhole with a coiled tubing string.

Further, the orienting device may be used to orient any borehole apparatus in the borehole which comprises all or a portion of the bottom hole assembly. However, preferably, the borehole apparatus is comprised of a downhole motor for drilling the borehole, wherein the downhole motor is connected with a drilling bit driven by the downhole motor. The downhole motor comprises or is included within the bottom hole assembly and is connected with the drill string such that it is powered by the circulation of fluid, such as drilling mud, supplied from the surface through the drill string, preferably a coiled tubing string.

In addition, the borehole apparatus is preferably comprised of a downhole motor including or connected with a bent housing or bent sub such that the drilling bit is driven by the downhole motor relative to the bent housing or bent sub. In this instance, the orienting device of the within invention is connected or associated with the borehole apparatus, being the downhole motor, such that actuation of the orienting device results in the orienting or rotation of the downhole motor including the bent housing or bent sub. As a result, the direction of the drilling bit, and the resulting borehole, may be adjusted in the borehole. To achieve this function, the orienting device of the within invention is connected between the coiled tubing string and the downhole motor.

Further, the orienting device may be any type of orienting device, mechanism or tool, and the orienting device may have any structure or configuration, compatible with and capable of being actuated by the actuator of the within invention as described herein. More particularly, the orienting device is comprised of an orienting mechanism which is actuated by longitudinal movement. Thus, the orienting device of the within invention may be any type of orienting device, mechanism or tool comprised of an orienting mechanism actuated by longitudinal movement.

The orienting mechanism of the orienting device may orient the borehole apparatus in any manner and by any degree or increments. In addition, the orienting device may orient the borehole apparatus by rotation in a clockwise direction, counterclockwise direction or both. However, in the preferred embodiment, the orienting device indexes the borehole apparatus a predetermined increment in a clockwise direction (when viewed from above) every pump cycle, i.e. every time the pump pumping or circulating the drilling fluid to the downhole motor is powered up and powered down to provide a complete cycle.

Further, the indexing may occur at any time during the pump cycle, i.e., during the powering up of the pump, the powering down of the pump or both, to provide the predetermined indexing increment. However, in the preferred embodiment, the orienting device indexes the borehole apparatus the predetermined increment upon the powering up of the pump to provide the necessary actuation pressure to drive or actuate the actuator. When the pump is powered down and the pressure is decreased to a level less than the actuation pressure, the orienting device simply resets itself in preparation for the next pump cycle. No further indexing occurs during the powering down of the pump.

The housing of the actuator may be comprised of a single integral tubular element or member defining the fluid passageway therethrough or it may be comprised of two or more such tubular elements or members connected, attached, mounted or otherwise affixed together, permanently or detachably, to provide the housing. Further, the housing may be connected, attached, mounted or otherwise affixed with the orienting device either permanently or detachably. However, in the preferred embodiment, the actuator housing is formed integrally with the orienting device.

Similarly, the actuator and the orienting device as a unit may be formed integrally with the other components of the bottom hole assembly or it may be connected, attached, mounted or otherwise affixed with the other components of the bottom hole assembly either permanently or detachably. More particularly, the actuator and the orienting device as a unit may be formed integrally with the borehole apparatus or it may be connected, attached, mounted or otherwise affixed with the borehole apparatus either permanently or detachably.

Finally, as discussed above, the actuator and the orienting device may be connected into the bottom hole assembly at any position or location therein permitting the functioning of the orienting device. However, preferably, the actuator and the orienting device as a unit are positioned or located between the drill string, preferably a coiled tubing string, and the borehole apparatus to be oriented, preferably a downhole motor. In this case, each of the uphole end and the downhole end of the combined actuator and orienting device may be directly or indirectly connected, attached, mounted or otherwise affixed with the coiled tubing string and the downhole motor respectively.

Thus, the bottom hole assembly may include any number of further downhole devices, apparatuses or tools. For instance, the bottom hole assembly typically includes one or more Measurement-While-Drilling ("MWD") devices, which are preferably connected into the bottom hole assembly between the orienting device and the downhole motor. Further, where desirable, the bottom hole assembly may include a dump or equalizer sub as described above. In this case, the dump or equalizer sub is also preferably connected into the bottom hole assembly between the orienting device and the downhole motor.

As indicated, the actuator is comprised of a longitudinally reciprocable piston positioned within the fluid passageway extending through the housing. Thus, the piston is exposed to the fluid within the fluid passageway. Further, the piston provides a first partial obstruction of the fluid passageway such that a pressure of the fluid within the fluid passageway may act upon the piston to cause the longitudinal movement of the piston within the housing.

The flow restrictor is similarly positioned within the fluid passageway and provides a second partial obstruction of the fluid passageway. The flow restrictor may similarly be longitudinally movable or reciprocable within the fluid passageway. However, preferably, the flow restrictor is at a fixed longitudinal position in the fluid passageway. As a result, in the preferred embodiment, the piston is longitudinally movable relative to the fixed longitudinal position of the flow restrictor.

Further, the flow restrictor and the piston are associated such that the first partial obstruction is longitudinally aligned with the second partial obstruction for a portion of a longitudinal range of travel of the piston to provide a combined obstruction of the fluid passageway. The range of travel of the piston extends between a first position of the piston and a second position of the piston. The piston may actuate the orienting mechanism by moving toward either the first position or the second position. However, preferably, the piston actuates the orienting mechanism by moving toward the second position. Further, the combined obstruction is preferably timed so that the fluid flow is restricted by the combined obstruction until the orientation of the bottom hole assembly, and particularly the borehole apparatus, has been completed, i.e., while the greatest work is being done by the orienting device.

Specifically, in the preferred embodiment, the first partial obstruction is longitudinally aligned with the second partial obstruction when the piston is at the first position. Movement of the piston toward the second position moves the first partial obstruction out of longitudinal alignment with the second partial obstruction.

The combined obstruction provided by the longitudinal alignment of the first and second partial obstructions may partially obstruct the fluid passageway, while still permitting the passage or movement of an amount of a fluid therethrough. However, preferably, the combined obstruction obstructs the fluid passageway substantially completely so that a fluid is substantially blocked from moving through the fluid passageway when the first partial obstruction is aligned with the second partial obstruction.

The flow restrictor may have any shape or configuration and be comprised of any mechanism, structure or device providing the second partial obstruction. In other words, the flow restrictor partially obstructs the fluid passageway, while permitting an amount of fluid to pass therethrough. The piston may have any shape or configuration and may be comprised of any hydraulically actuated mechanism, structure or device reciprocable within the fluid passageway and providing the first partial obstruction. In other words, the piston also partially obstructs the fluid passageway, while permitting an amount of fluid to pass therethrough. Finally, the flow restrictor and the piston must be selected to be compatible such that the first partial obstruction is capable of being longitudinally aligned with the second partial obstruction to provide the combined obstruction of the fluid passageway.

Each of the first and second partial obstructions may obstruct the fluid passageway in any manner. For instance, upon cross-section of the combined obstruction, each of the first and second partial obstructions may contribute to the combined obstruction and be related to each other or positioned within the fluid passageway relative to each other in any manner. Thus, the piston and the flow restrictor may be related to each other or positioned within the fluid passageway relative to each other in any manner. However, preferably, one of the piston and the flow restrictor provides an outer partial obstruction, while the other of the piston and the flow restrictor provides an inner partial obstruction. Thus, the inner partial obstruction fits or is positioned within the outer partial obstruction to provide the combined obstruction. In the preferred embodiment, the piston is comprised of an annular sleeve having an internal bore and the flow restrictor is positioned within the internal bore when the first partial obstruction is aligned with the second partial obstruction.

BRIEF DESCRIPTION OF DRAWINGS

Embodiments of the invention will now be described with reference to the accompanying drawings, in which:

FIGS. 4 through 8 are detailed longitudinal sectional views of the actuator and the orienting device as shown in FIG. 3, wherein FIGS. 5 through 8 are lower continuations of FIGS. 4 through 7 respectively.

DETAILED DESCRIPTION

Figure 1:
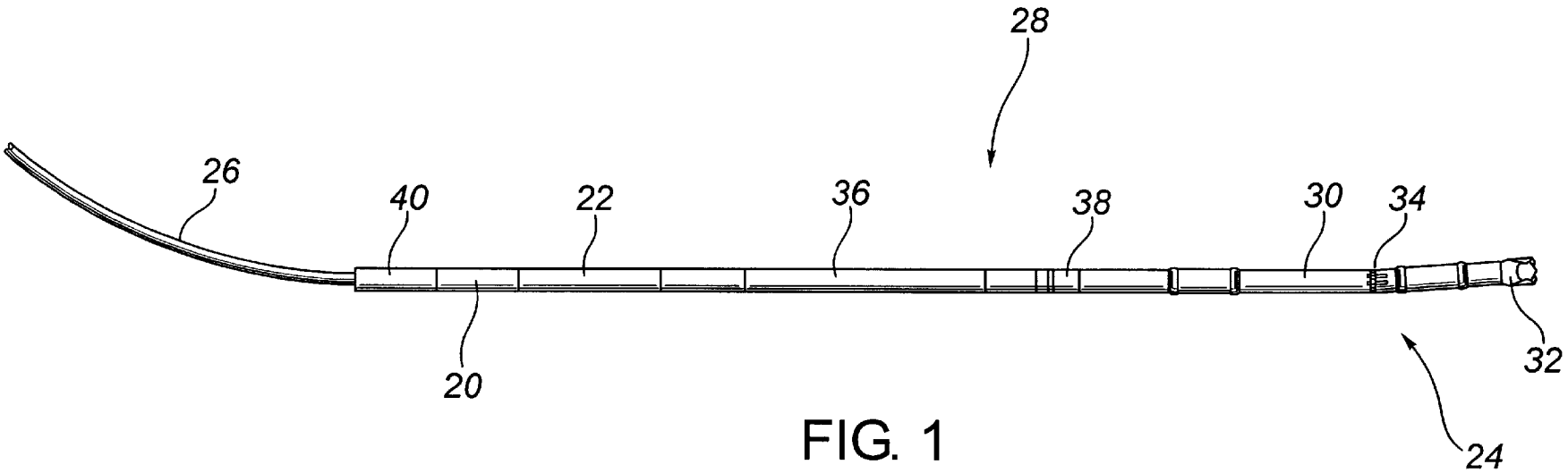
FIG. 1 is a side view of a bottom hole assembly including a preferred embodiment of an actuator and an orienting device of the within invention for orienting a borehole apparatus in a borehole.

Referring to FIG. 1, the within invention is comprised of an actuator (20) for an orienting device (22) and an orienting device (22) comprised of the actuator (20). In any event, the actuator (20) and the orienting device (22) are provided for orienting a borehole apparatus (24) in a borehole. In particular, as shown in FIG. 1, the actuator (20) and the orienting device (22) are connected with a lower or downhole end of a coiled tubing (26) and are used for orienting the borehole apparatus (24) in a coiled tubing (26) drilling application. Thus, the within invention has particular application for directional and horizontal drilling.

In the preferred embodiment, the actuator (20) and the orienting device (22) comprise or are included within a bottom hole assembly (28) in the borehole. The bottom hole assembly (28) is connected with the coiled tubing (26) and lowered into the borehole. The borehole apparatus (24) to be oriented by the orienting device (22) may be comprised of any part or portion of the bottom hole assembly (28). However, for drilling applications, the bottom hole assembly (28) is further comprised of a downhole motor (30) connected with a drilling bit (32) for drilling the borehole. In this instance, the borehole apparatus (24) to be oriented by the orienting device (22) is comprised of the downhole motor (30).

Any type of downhole motor (30) and drilling bit (32) compatible with the particular drilling operation may be used. However, typically, the downhole motor (30) is comprised of a bent housing or bent sub (34). The orienting device (22) is preferably connected into or positioned within the bottom hole assembly (28) between the coiled tubing (26) and the downhole motor (30) for adjusting the orientation of the bent housing or bent sub (34) and thus adjusting the orientation of the drilling bit (32). Further, a fluid, preferably a drilling fluid such as drilling mud, is pumped by a pump from the surface and through the coiled tubing (26) to the bottom hole assembly (28). The drilling fluid from the coiled tubing (26) is moved or circulated through the actuator (20) and the orienting device (22) to the downhole motor (30) to power the motor (30) and drive the drilling bit (32).

Further, the bottom hole assembly (28) may include any number of further downhole devices, apparatuses or tools. For instance, referring to FIG. 1, in the preferred embodiment, the bottom hole assembly (28) includes a Measurement-While-Drilling ("MWD") device (36) connected into the bottom hole assembly (28) between the orienting device (22) and the downhole motor (30). Further, where desirable, the bottom hole assembly (28) includes a dump or equalizer sub (38) connected into the bottom hole assembly (28) between the orienting device (22) and the downhole motor (30), and more particularly, between the MWD (36) and the downhole motor (30).

Thus, in the preferred embodiment, the bottom hole assembly (28) is comprised of a cross-over sub (40) for connecting the upper or uphole end of the bottom hole assembly (28) with the coiled tubing (26). Then, connected in order from the uphole end to the downhole end, the bottom hole assembly (28) is comprised of the actuator (20), the orienting device (22), the MWD (36), the dump or equalizer sub (38) and the downhole motor (30) including the bent housing or bent sub (34) and the drilling bit (32).

The coiled tubing (26) and each of the parts or components of the bottom hole assembly (28) may be formed integrally with the other components of the bottom hole assembly (28) or may be connected, attached, mounted or otherwise affixed with the other components of the bottom hole assembly (28) either permanently or detachably. In the preferred embodiment, the coiled tubing (26) is threadably connected with the bottom hole assembly (28), and particularly the cross-over sub (40), and each of the components of the bottom hole assembly (28) are threadably connected or welded together.

The orienting device (22) is comprised of an orienting mechanism (42), as described further below, which is actuated by longitudinal movement. Further, the actuator (20) actuates the orienting mechanism (42) by providing the necessary longitudinal movement. Referring to FIGS. 2 through 8, the actuator (20) is comprised of an actuator housing (44) having a first end (46), a second end (48) and an inner surface (49). The orienting device (22) is comprised of an orienter housing (50) having a first end (52), a second end (54) and an inner surface (55).

The first end (46) of the actuator housing (44) is adapted for connection with a lower or downhole end of the cross-over sub (40). Specifically, the first end (46) is comprised of a threaded inner surface (56) for engagement with a compatible threaded outer surface (58) of the cross-over sub (40). The second end (48) of the actuator housing (44) is preferably integrally formed with the first end (52) of the orienter housing (50) to provide a single integral unit. However, alternatively, the second end (48) of the actuator housing (44) may be connected, attached, mounted or otherwise affixed in any manner with the first end (52) of the orienter housing (50), either permanently or detachably, such as by welding or a threaded connection therebetween.

The actuator housing (44) may be comprised of a single integral tubular element or member. However, the actuator housing (44) is preferably comprised of two or more such tubular elements or members connected, attached, mounted or otherwise affixed together, permanently or detachably, to provide the housing (44). In the preferred embodiment, the actuator housing (44) is comprised of a flow sub housing (60) connected with a piston sub housing (62). The flow sub housing (60) has a first end (64) defining the first end (46) of the actuator housing (44) and a second end (66). The piston sub housing (62) has a first end (68) and a second end (70) defining the second end (48) of the actuator housing (44). Further, the second end (66) of the flow sub housing (60) is comprised of a threaded outer surface (72) for engagement with a compatible threaded inner surface (74) which comprises the first end (68) of the piston sub housing (62).

The actuator (20) is further comprised of a fluid passageway (76) extending through the actuator housing (44) from the first end (46) to the second end (48). The fluid passageway (76) is provided for conducting fluid, particularly drilling fluid, through the actuator (20) from the coiled tubing (26) to the orienting device (22), and subsequently to the downhole motor (30). Thus, the fluid passageway (76) is in fluid communication with the coiled tubing (26) and the components of the bottom hole assembly (28) downhole of the orienting device (22).

In addition, the actuator (20) is comprised of a piston (78) which is positioned within the fluid passageway (76) and which is longitudinally reciprocable therein. In other words, the piston (78) is permitted to reciprocate within the fluid passageway (76) along the longitudinal axis of the actuator housing (44). Further, the piston (78) provides a first partial obstruction (80) of the fluid passageway (76). The first partial obstruction (80) partially obstructs the fluid passageway (76) only. Thus, a portion or amount of fluid, such as drilling fluid, would be permitted to flow past the first partial obstruction (80). The piston (78) may have any shape or configuration and be comprised of any mechanism, structure or device able to provide the first partial obstruction (80) in the fluid passageway (76).

However, in the preferred embodiment, the piston (78) is comprised of an annular sleeve (82) having an outer surface (84), an internal bore (86), an upper end (88) and a lower end (90). The piston (78) is positioned within the fluid passageway (76) extending through the actuator housing (44). When positioned within the fluid passageway (76), the outer surface (84) of the annular sleeve (82) is adjacent the inner surface (49) of the actuator housing (44). Further, any fluids passing through or within the actuator (20) move through the internal bore (86) of the annular sleeve (82) between the upper and lower ends (88, 90). Finally, the cross-sectional area of the annular sleeve (78) within the fluid passageway (76), and more particularly, the cross-sectional area of the upper end (88) of the annular sleeve (82), provides the first partial obstruction (80).

As indicated, the piston (78), and particularly the annular sleeve (82), has a longitudinal range of travel within the fluid passageway (76). Preferably, the longitudinal range of travel of the piston (78) or annular sleeve (82) extends between a first position of the piston (78) and a second position of the piston (78). The piston (78), and particularly the annular sleeve (82), engages the orienting mechanism (42) of the orienting device (22) such that the longitudinal movement of the annular sleeve (82) actuates the orienting mechanism (42) as described further below. The annular sleeve (82) may actuate the orienting mechanism (42) by moving toward either the first position or the second position. However, in the preferred embodiment, the annular sleeve (82) actuates the orienting mechanism (42) by moving toward the second position.

Figure 3:
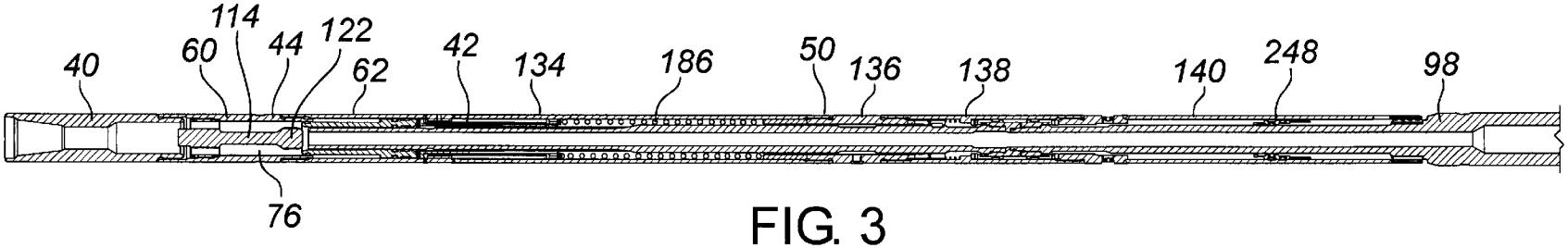
FIG. 3 is a longitudinal sectional view of the actuator and the orienting device of FIG. 2, wherein the piston is shown in a second position.
Figure 2:
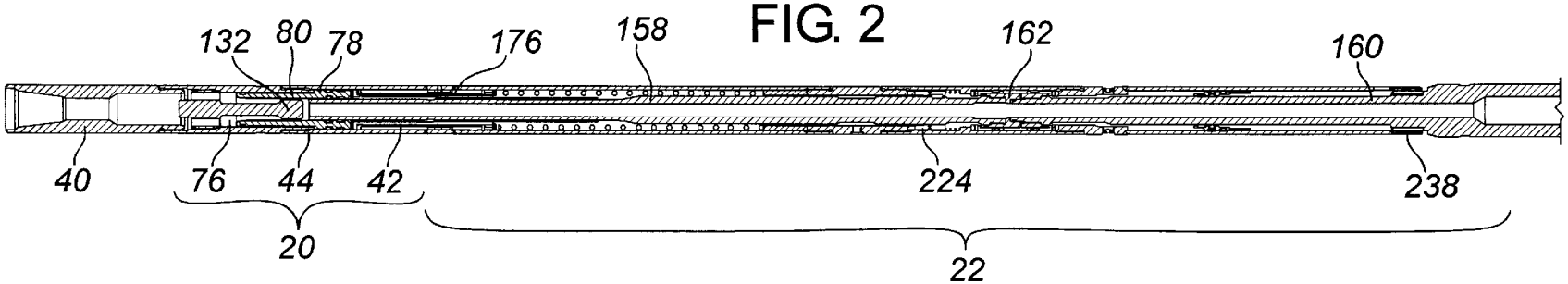
FIG. 2 is a longitudinal sectional view of the actuator and the orienting device of FIG. 1, wherein the actuator is comprised of a piston shown in a first position.
Figure 4:
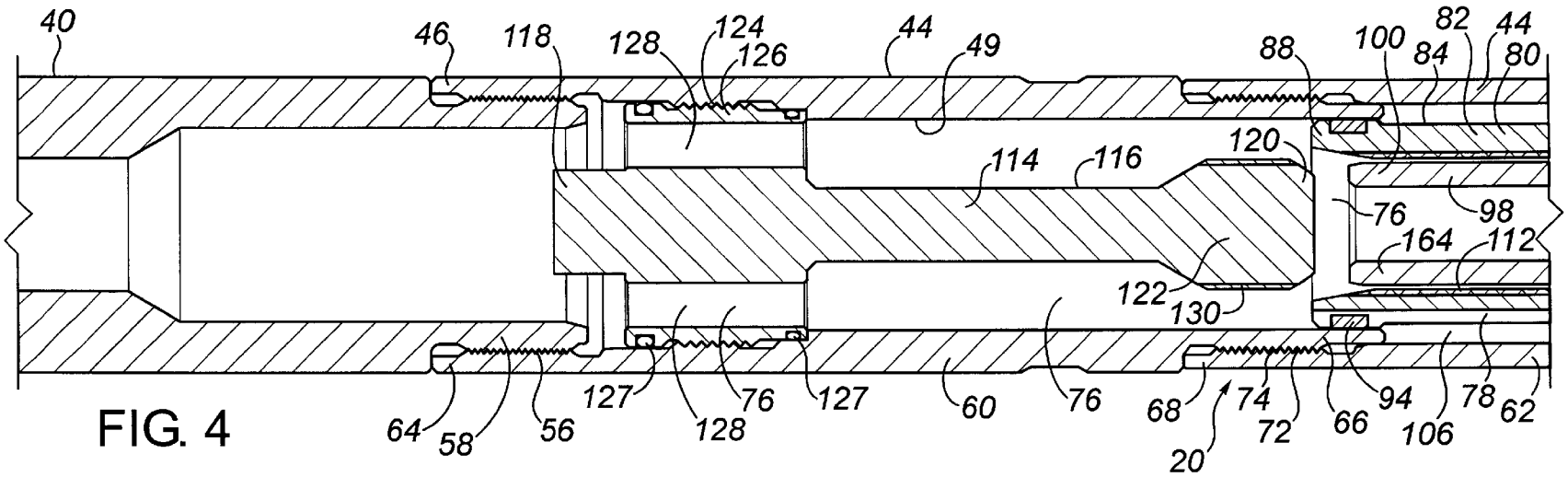
Figure 5:
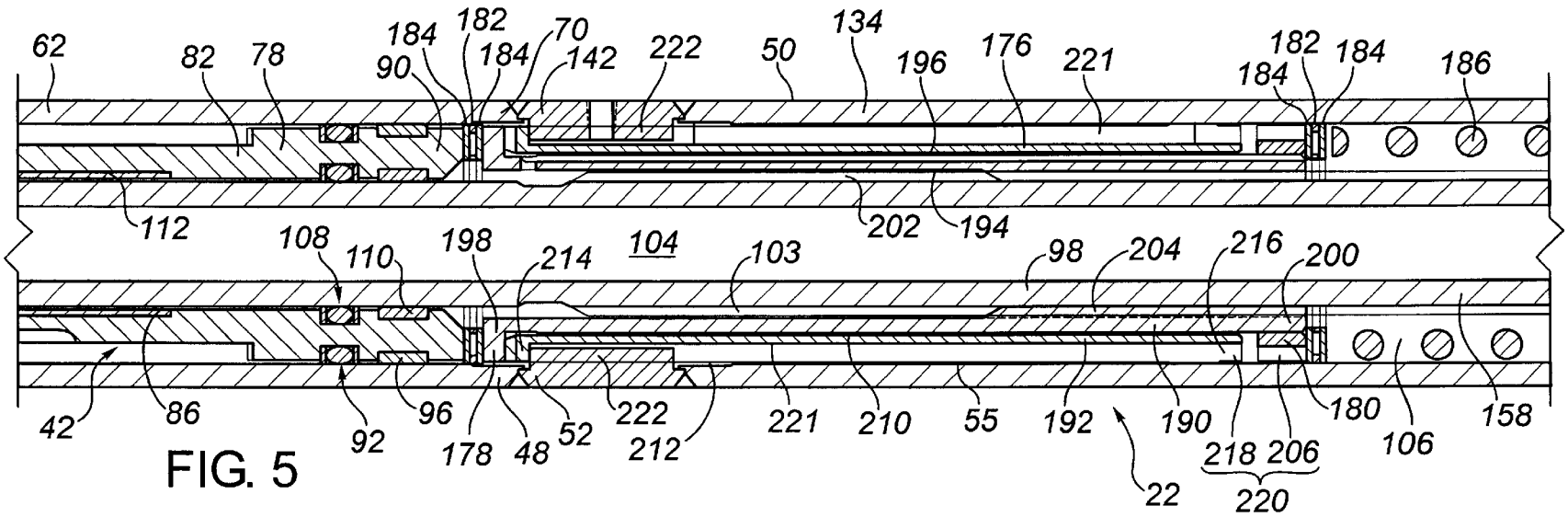
Figure 6:
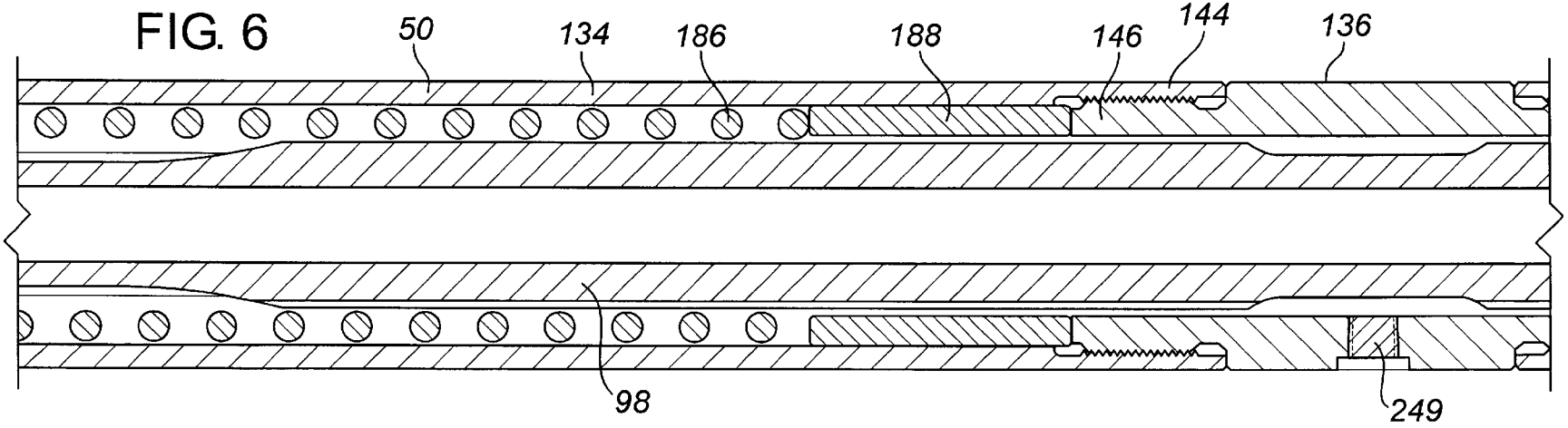
Figure 7:
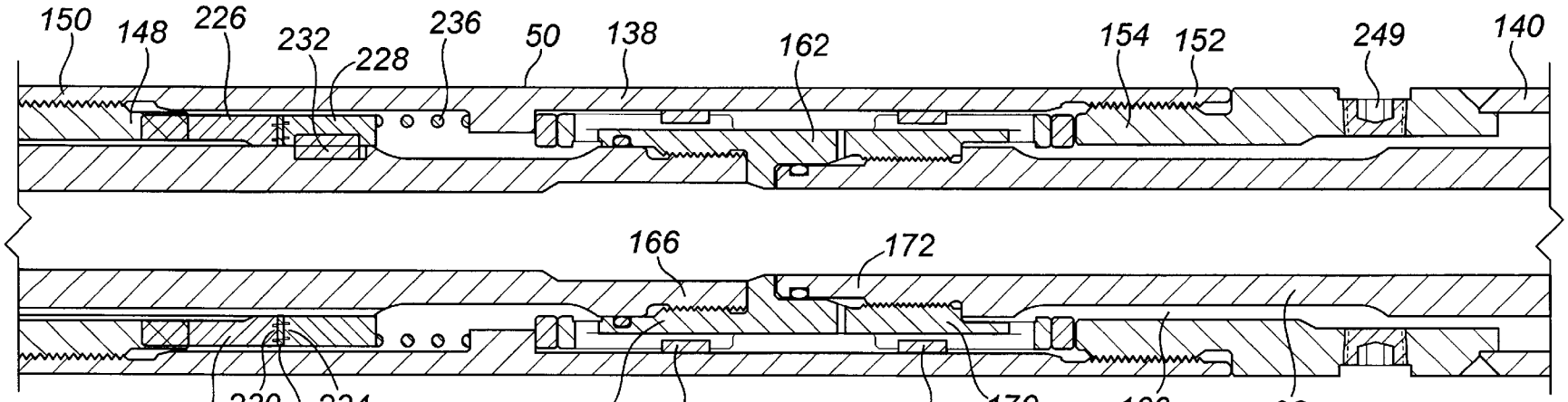
Figure 8:
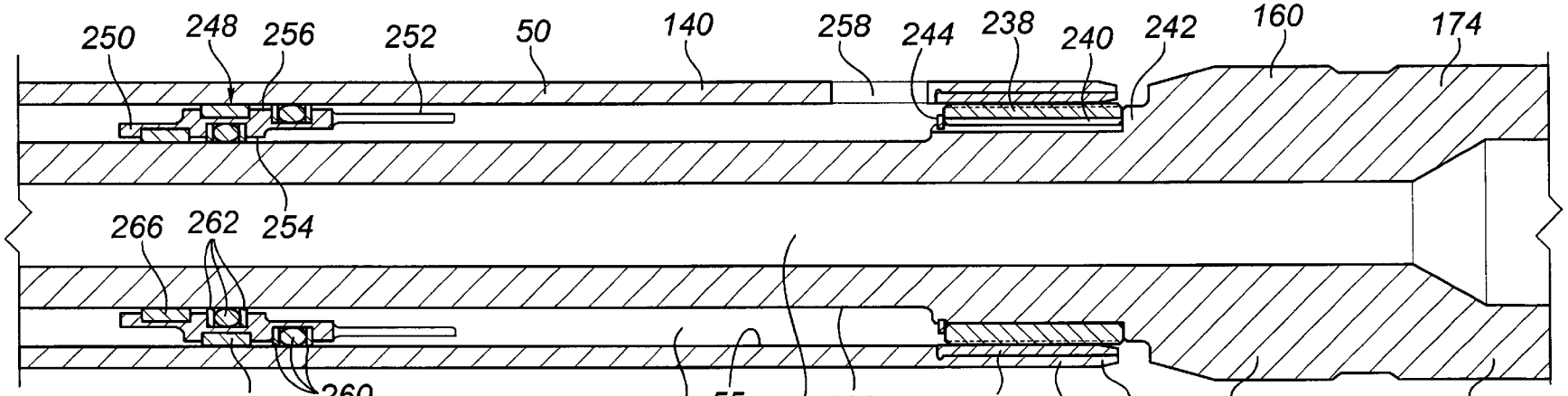

Thus, in the preferred embodiment, the lower end (90) of the annular sleeve (82) abuts against or otherwise engages the orienting mechanism (42). Referring to FIG. 3, in the second position of the piston (78), the annular sleeve (82) is positioned within the portion of the fluid passageway (76) within the piston sub housing (62). The upper end (88) of the annular sleeve (82) is adjacent or proximal to the first end (68) of the piston sub housing (62), while the lower end (90) of the annular sleeve (82) is adjacent or proximal to the second end (70) of the piston sub housing (62). Referring to FIG. 2, in the first position of the piston (78), the annular sleeve (82) is positioned partially within the portion of the fluid passageway (76) within the piston sub housing (62) and partially within the portion of the fluid passageway (76) within the flow sub housing (60). The upper end (88) of the annular sleeve (82) extends from the first end (68) of the piston sub housing (62) and through the second end of the flow sub housing (60) into the flow sub housing (60). The lower end (90) of the annular sleeve (82) continues to be positioned within the piston sub housing (62).

As indicated, when positioned within the fluid passageway (76), the outer surface (84) of the annular sleeve (82) is adjacent the inner surface (49) of the actuator housing (44). Preferably, the outer surface (84) of the annular sleeve (82) sealingly engages the inner surface (49) of the actuator housing (44) to inhibit the passage of fluid between the actuator (20), and particularly the fluid passageway (76), and the orienting device (22) connected thereto. In the preferred embodiment, the piston (78) is further comprised of an outer sealing assembly (92) for sealing between the outer surface (84) of the annular sleeve (82) and the inner surface (49) of the actuator housing (44) The outer sealing assembly (92) may be comprised of one or more seals or any sealing structure or device suitable for sealing between the adjacent surfaces (84, 49), particularly upon the longitudinal movement of the annular sleeve (82) relative to the actuator housing (44). Further, the outer sealing assembly (92) may be located at any position along the length of the outer surface (84) of the annular sleeve (82). However, preferably, the outer sealing assembly (92) is positioned adjacent or in proximity to the lower end (90) of the annular sleeve (82).

Further, in the preferred embodiment, the piston (78) is further comprised of one or more outer wear rings positioned about or mounted within the outer surface (84) of the annular sleeve (82). In the preferred embodiment, an upper outer wear ring (94) is positioned or mounted within the outer surface (84) of the annular sleeve (82) at, adjacent or in proximity to the upper end (88) of the annular sleeve (82). In addition, a lower outer wear ring (96) is positioned or mounted within the outer surface (84) of the annular sleeve (82) at, adjacent or in proximity to the lower end (90) of the annular sleeve (82).

As well, as described further below, the orienting mechanism (42) is comprised of an output shaft (98) having an upper end (100), a lower end (102) and an outer surface (103). The shaft (98) defines a bore (104) therethrough extending between the upper and lower ends (100, 102) for conducting fluid therethrough. The shaft (98) is primarily positioned within the orienter housing (50). However, in the preferred embodiment, the upper end (100) of the shaft (98) extends from the first end (52) of the orienter housing (50), through the second end (48) of the actuator housing (44) and into the actuator housing (44) such that the upper end (100) of the shaft (98) is positioned therein. In particular, the upper end (100) of the shaft (98) extends into the piston sub housing (62) through the second end (70) and terminates at, adjacent or in proximity to the first end (68) of the piston sub housing (62). Further, the fluid passageway (76) of the actuator (20) is in communication with the bore (104) of the shaft (98) such that fluid from the fluid passageway (76) passes into the bore (104) at the upper end (100) of the shaft (98).

As well, the lower end (102) of the shaft (98) extends from the second end (54) of the orienter housing (50) for connection with the borehole apparatus (24) either directly or indirectly such that rotation of the shaft (98) orients the borehole apparatus (24). An annular space (106) is defined between the outer surface (103) of the shaft (98) and the adjacent inner surfaces (49, 55) of the actuator housing (44) and orienter housing (50) respectively. The annular sleeve (82) of the piston (78) is positioned within the annular space (106) defined between the outer surface (103) of the shaft (98) and the inner surface (49) of the actuator housing (44). Further, the internal bore (86) of the annular sleeve (82) is slidably or longitudinally movable about the upper end (100) of the shaft (98) within the annular space (106). Referring to FIG. 3, in the second position of the piston (78), the upper end (88) of the annular sleeve (82) is positioned adjacent or proximal to the upper end (100) of the shaft (98). Referring to FIG. 2, in the first position of the piston (78), the upper end (88) of the annular sleeve (82) extends from or beyond the upper end (100) of the shaft (98).

Preferably, the inner bore (86) of the annular sleeve (82) sealingly engages the outer surface (103) of the shaft (98) to further inhibit the passage of fluid between the actuator (20), and particularly the fluid passageway (76), and the orienting device (22) connected thereto. In the preferred embodiment, the piston (78) is further comprised of an inner sealing assembly (108) for sealing between the internal bore (86) of the annular sleeve (82) and the outer surface (103) of the shaft (98) The inner sealing assembly (108) may be comprised of one or more seals or any sealing structure or device suitable for sealing between the adjacent surfaces (86, 103), particularly upon the longitudinal movement of the annular sleeve (82) relative to the shaft (98). Further, the inner sealing assembly (108) may be located at any position along the length of the internal bore (86) of the annular sleeve (82). However, preferably, the inner sealing assembly (108) is positioned adjacent or in proximity to the lower end (90) of the annular sleeve (82).

Thus, the combination of the inner sealing assembly (108) and the outer sealing assembly (98) inhibit the passage of fluids through the annular space (106) past the piston (78).

Further, in the preferred embodiment, the piston (78) is further comprised of one or more inner wear rings positioned about or mounted within the internal bore (86) of the annular sleeve (82). In the preferred embodiment, an inner wear ring (110) is positioned or mounted within the internal bore (86) of the annular sleeve (82) at, adjacent or in proximity to the lower end (90) of the annular sleeve (82). As well, the internal bore (86) of the annular sleeve (82) at, adjacent or in proximity to the upper end (88) of the annular sleeve (82) may include a further wear ring. However, in the preferred embodiment, the internal bore (86) of the annular sleeve (82) at, adjacent or in proximity to the upper end (88) of the annular sleeve (82) is comprised of a wear resistant insert, such as a carbide insert (112).

The actuator (20) is further comprised of a flow restrictor (114) having an outer surface (116), an upper end (118) and a lower end (120). The flow restrictor (114) is similarly positioned within the fluid passageway (76) and provides a second partial obstruction (122) of the fluid passageway (76). The flow restrictor (114) may similarly be longitudinally movable or reciprocable within the fluid passageway (76). However, preferably, the flow restrictor (114) is at a fixed longitudinal position in the fluid passageway (76). As a result, in the preferred embodiment, the piston (78), and particularly the annular sleeve (82), is longitudinally movable relative to the fixed longitudinal position of the flow restrictor (114).

As stated, the flow restrictor (114) provides the second partial obstruction (122) of the fluid passageway (76). The second partial obstruction (122) partially obstructs the fluid passageway (76) only. Thus, a portion or amount of fluid, such as drilling fluid, would be permitted to flow past the second partial obstruction (122). The flow restrictor (114) may have any shape or configuration and be comprised of any mechanism, structure or device able to provide the second partial obstruction (122) in the fluid passageway (76).

In the preferred embodiment, the outer surface (116) of the flow restrictor (114) at, adjacent or in proximity to its upper end (118) is fixedly mounted, connected, attached or otherwise affixed, either permanently or detachably, with the inner surface (49) of the actuator housing (44). More particularly, the outer surface (116) is affixed with the flow sub housing (60) at, adjacent or in proximity to its first end (64). In the preferred embodiment, the inner surface (49) of the actuator housing (44) is comprised of a threaded inner portion (124) for engaging a compatible threaded outer portion (126) of the outer surface (116) of the upper end (118) of the flow restrictor (114). As well, the threaded inner portion (124) preferably sealingly engages the threaded outer portion (126). One or more seals (127), such as an 0-ring, or any other sealing structure or mechanism may be used to provide the desired seal therebetween.

In order to permit flow of a fluid through the fluid passageway (76) past the upper end (118) of the flow restrictor (114) when it is threadably engaged with the actuator housing (44), the upper end (118) of the flow restrictor (114) defines one or more conduits (128) extending therethrough. The lower end (120) of the flow restrictor (114) extends from the upper end (118) into the fluid passageway (76) spaced apart from the inner surface (49) of the actuator housing (44). Further, in the preferred embodiment, the lower end (120) of the flow restrictor (114) is positioned within the fluid passageway (76) at, adjacent or in proximity to the second end (66) of the flow sub housing (60). The lower end (120) of the flow restrictor (114) provides the second partial obstruction (122). Specifically, the cross-sectional area of the lower end (120) of the flow restrictor (114) provides the second partial obstruction (122). However, the outer surface (116) of the lower end (120) of the flow restrictor (114) is a spaced distance from the inner surface (49) of the actuator housing (44) to permit the flow of a fluid through the fluid passageway (76) past the second partial obstruction (122). As well, for reasons discussed below, the outer surface (116) of the lower end (120) of the flow restrictor (114) is preferably comprised of a wear resistant material or a wear resistant insert (130), such as a carbide insert.

The flow restrictor (114) and the annular sleeve (82) are associated and positioned within the actuator housing (44) such that the first partial obstruction (80) provided by the annular sleeve (82) is longitudinally aligned with the second partial obstruction (122) provided by the flow restrictor (114) for a portion of the longitudinal range of travel of the piston (78) between the first and second positions to provide a combined obstruction (132) of the fluid passageway (76) as shown in FIG. 2.

Specifically, in the preferred embodiment, the first partial obstruction (80) is longitudinally aligned with the second partial obstruction (122) when the piston is at the first position to provide the combined obstruction (132). Movement of the annular sleeve (82) of the piston (78) toward the second position moves the first partial obstruction (80) out of longitudinal alignment with the second partial obstruction (122). When out of longitudinal alignment, as in the second position, fluid flow through the fluid passageway (76) is permitted past both the first and second partial obstructions (80, 122).

The combined obstruction (132) provided by the longitudinal alignment of the first and second partial obstructions (80, 122) may partially obstruct the fluid passageway (76) while still permitting the passage or movement of an amount of a fluid therethrough. However, in the preferred embodiment, the combined obstruction (132) obstructs the fluid passageway (76) substantially completely so that a fluid is substantially blocked from moving through the fluid passageway (76) when the first partial obstruction (80) is aligned with the second partial obstruction (122).

Thus, the flow restrictor (114) and the piston (78) are selected to be compatible such that the first partial obstruction (80) is capable of being longitudinally aligned with the second partial obstruction (122) to provide the combined obstruction (132) of the fluid passageway (76). In the preferred embodiment, the second partial obstruction (122) provided by the flow restrictor (114) fits or is positioned within the first partial obstruction (80) provided by the annular sleeve (82) to provide the combined obstruction (132). In other words, the lower end (120) of the flow restrictor (114) is positioned within the internal bore (86) of the annular sleeve (82).

In operation, when the pumps for the drilling fluid are off or in a "pumps off" position, as shown in FIG. 2, the lower end (120) of the flow restrictor (114) is positioned within the internal bore (86) of the annular sleeve (114) to provide the combined obstruction (132) which substantially completely obstructs the fluid passageway (76) through the actuator (20) and thus substantially restricts or prevents the flow of a fluid, particularly the drilling fluid, therethrough.

When the pumps are turned on or placed in a "pumps on"position, the pressure of the drilling fluid being pumped from the coiled tubing string (26) into the fluid passageway (76) of the actuator (20), through the first end (46) of the actuator housing (44), acts directly upon the piston (78), particularly the upper end (88) of the annular sleeve (82). As described further below, the annular sleeve (82) is biased towards the first position by a biasing force. Once the pressure acting upon the annular sleeve (82) is sufficient to overcome the biasing force, the annular sleeve (82) moves longitudinally toward the second position. The movement of the annular sleeve (82) toward the second position gradually moves the first partial obstruction (80) out of longitudinal alignment with the second partial obstruction (122). Further, the longitudinal movement of the annular sleeve (82) toward the second position actuates the orienting mechanism (42) of the orienting device (22) as described further below.

Once the annular sleeve (82) reaches the second position, as shown in FIG. 3, and the first and second partial obstructions (80, 122) are out of longitudinal alignment, flow of the drilling fluid is permitted through the fluid passageway (76) of the actuator (20) and subsequently to the borehole apparatus (24) including the downhole motor (30). When this occurs, a visible pressure drop in the drilling fluid may be noted, which provides a positive surface indication that the actuator (20) and the orienting device (22) have fully cycled. Once the orienting device (22) has cycled, the pressure of the drilling fluid may be decreased as only sufficient pressure is required to act against the biasing force to maintain the annular sleeve (82) in the second position.

When the pumps are subsequently placed in the "pumps off" position, the biasing force acting upon the annular sleeve (82) moves the annular sleeve (82) longitudinally back toward the first position.

As stated, the orienting device (22) is comprised of an orienting mechanism (42) which is actuated by longitudinal movement. The orienting mechanism (42) may orient the borehole apparatus (24), particularly the downhole motor (30), in any manner and by any degree or increments. However, in the preferred embodiment, the orienting mechanism (42) indexes the borehole apparatus (24) a predetermined increment in preferably a clockwise direction (when viewed from above) every pump cycle, i.e. every time the pump is powered up to a "pumps on" position and subsequently powered down to a "pumps off" position to provide the complete cycle. In the preferred embodiment, the indexing specifically occurs during the "pumps on" position, while the orienting mechanism (42) is simply re-set for the next cycle in the "pumps off" position. The orienting mechanism (42) may index the borehole apparatus (24) any desired increment or number of degrees per cycle.

Referring to FIGS. 2, 3 and 5–9, the orienting device (22) is comprised of the orienter housing (50). The orienter housing (50) extends from the first end (52), which is integrally formed with the second end (48) of the actuator housing (44), to the second end (54) downhole. The orienter housing (50) may be comprised of a single integral tubular element or member. However, the orienter housing (50) is preferably comprised of two or more such tubular elements or members connected, attached, mounted or otherwise affixed together, permanently or detachably, to provide the housing (50). In the preferred embodiment, the orienter housing (50) is comprised of a top housing (134), a ratchet housing (136), a mid housing (138) and a bottom housing (140). The adjacent ends of each housing (134, 136, 138, 140) may be connected, mounted, attached or otherwise affixed together, permanently or detachably, by any suitable fastening structure or mechanism. However, preferably, the adjacent ends of each housing (134, 136, 138, 140) are threadably engaged together by compatible threaded inner and outer surfaces.

In the preferred embodiment, the top housing (134) has an upper end (142) defining the first end (52) of the orienter housing (50) and a lower end (144). The lower end (144) of the top housing (134) is threadably engaged with an upper end (146) of the ratchet housing (136). A lower end (148) of the ratchet housing (136) is threadably engaged with an upper end (150) of the mid housing (138). A lower end (152) of the mid housing (138) is threadably engaged with an upper end (154) of the bottom housing (140). Finally, a lower end (156) of the bottom housing (140) defines the second end (54) of the orienter housing (50).

Further, the orienting device (22) is comprised of the shaft (98) as described above. The shaft (98) may be comprised of a single integral tubular element or member. However, the shaft (98) is preferably comprised of two or more such tubular elements or members connected, attached, mounted or otherwise affixed together, permanently or detachably, to provide the shaft (98). In the preferred embodiment, the shaft (98) is comprised of a top shaft (158) and a bottom shaft (160) interconnected by a shaft coupling (162). More particularly, the top shaft (158) has an upper end (164) defining the upper end (100) of the shaft (98) and a lower end (166). The lower end (166) of the top shaft (158) is threadably engaged with an upper end (168) of the shaft coupling (162). A lower end (170) of the shaft coupling (162) is threadably engaged with an upper end (172) of the bottom shaft (160). A lower end (174) of the bottom shaft (160) defines the lower end (102) of the shaft (98) which extends from the second end (54) of the orienter housing (50) for connection with the borehole apparatus (24). Finally, one or more wear rings (163) may be associated with the shaft coupling (162), and positioned between the shaft coupling (162) and the adjacent inner surface (55) of the orienter housing (50).

Further, as discussed above, an annular space (106) is defined between the outer surface (103) of the shaft (98) and the adjacent inner surfaces (49, 55) of the actuator housing (44) and orienter housing (50) respectively. The orienting mechanism (42) and the other components of the orienting device (22) are located or positioned within the annular space (106). For instance, the orienting mechanism (42) is comprised of a shuttle cam assembly (176), as shown particularly in FIG. 9, having an upper end (178) and a lower end (180).

The upper end (178) of the shuttle cam assembly (176) abuts against or engages, directly or indirectly, the lower end (90) of the annular sleeve (82) such that longitudinal movement of the annular sleeve toward the second position moves the shuttle cam assembly (176) longitudinally in the annular space (106). Preferably, one or more bearings are positioned or located between the lower end (90) of the annular sleeve (82) and the upper end (178) of the shuttle cam assembly (176). Although any number or type of bearings may be positioned therebetween, in the preferred embodiment, a needle bearing (182) is held in position between two bearing spacers (184) which abut against the adjacent ends (90, 178) of the annular sleeve (82) and shuttle cam assembly (176).

The orienting mechanism is further comprised of a biasing mechanism (186) for providing the biasing force as discussed above. The annular sleeve (82) is biased towards the first position by the biasing force. The biasing force may be exerted directly upon the annular sleeve (82). However, in the preferred embodiment, the biasing force is exerted indirectly on the annular sleeve (82) through the shuttle cam assembly (176) by the biasing mechanism (186). Specifically, the biasing mechanism (186) exerts the biasing force upon or at the lower end (180) of the shuttle cam assembly (176). The biasing force exerted at the lower end (180) biases the shuttle cam assembly (176) uphole or in the direction of the annular sleeve (82). Thus, the upper end (178) of the shuttle cam assembly (176) acts upon the annular sleeve (82) to bias the annular sleeve (82) toward the first position.

Any mechanism, structure or device able to provide the biasing force may be used. However, in the preferred embodiment, the biasing mechanism (186) is comprised of a spring return mechanism comprised of one or more springs. More particularly, the spring return (186) is positioned within the annular space (106) between the lower end (180) of the shuttle cam assembly (176) and the upper end (146) of the ratchet housing (136). The lower end (180) of the shuttle cam assembly (176) abuts against or engages, directly or indirectly, the spring return (186) such that longitudinal movement of the shuttle cam assembly (176) moves the annular sleeve (82) longitudinally toward the first position. Thus, in the preferred embodiment, the spring return (186) is compressed as the annular sleeve (82) moves longitudinally toward the second position. Therefore, the biasing force provided by the spring return (186) to return the annular sleeve (82) to the first position is a compressive force.

Preferably, one or more bearings are positioned or located between the lower end (180) of the shuttle cam assembly (176) and the spring return (186). Although any number or type of bearings may be positioned therebetween, in the preferred embodiment, a needle bearing (182) is held in position between two bearing spacers (184) which abut against the adjacent ends (180, 186) of the shuttle cam assembly (176) and spring return (186). Further, where required, one or more spring spacers (188) may be located or positioned between the upper end (146) of the ratchet housing (136) and the spring return (186).

Figure 9:
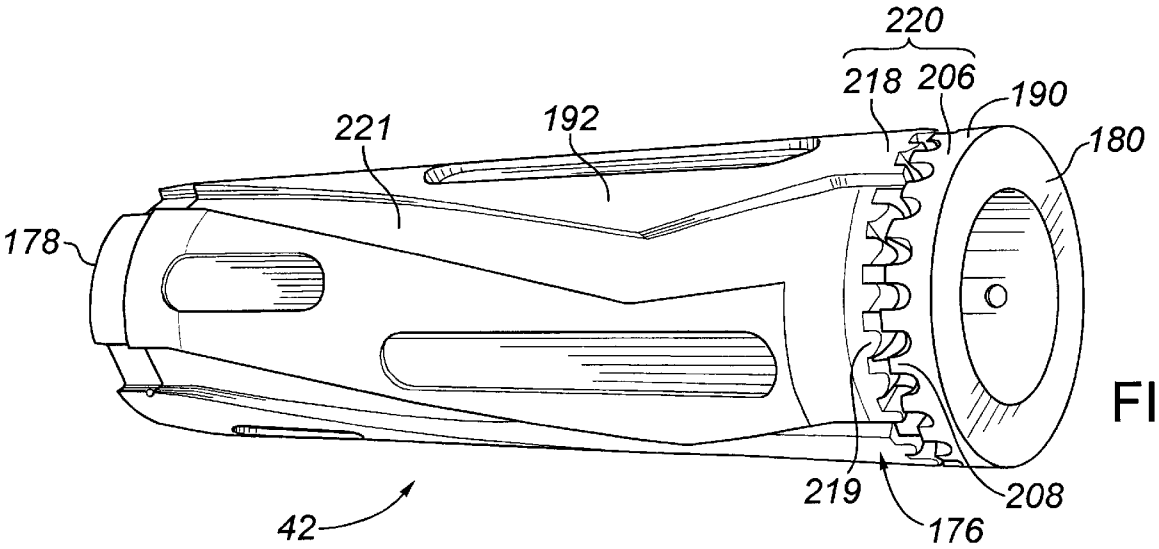
FIG. 9 is a side view of a shuttle cam assembly of the orienting device of FIGS. 2 and 3.

The shuttle cam assembly (176) is comprised of a shuttle (190) and a helical cam (192). The shuttle (190) has an internal bore (194), an outer surface (196), an upper end (198) defining the upper end (178) of the shuttle cam assembly (176) and a lower end (200). The lower end (200) of the shuttle (190) is comprised of a lower clutch member (206) having a plurality of upwardly facing clutch teeth (208) as shown in FIG. 9. The shaft (98), and particularly the top shaft (158), extends through the internal bore (194) of the shuttle (190). Further, the outer surface (103) of the shaft (98) adjacent the shuttle (190) defines one or more longitudinal grooves (202) therein. The adjacent internal bore (194) of the shuttle (190) is comprised of one or more compatible longitudinal splines or keys (204) which are received within the longitudinal grooves (202). As a result, the shuttle (190) is movable longitudinally relative to the shaft (98) as the splines (204) are guided or directed within the corresponding compatible grooves (202). However, the engagement or receipt of the splines (204) within the grooves (202) prevents any rotation of the shaft (98) relative to the shuttle (190).

The helical cam (192) similarly has an internal bore (210), an outer surface (212), an upper end (214) and a lower end (216). The helical cam (192) is positioned about the shuttle (190) between the shuttle (190) between the upper and lower ends (198, 200) of the shuttle (190). The upper end (214) of the helical cam (192) abuts against the upper end (198) of the shuttle (190). The lower end (216) of the helical cam (192) is comprised of an upper clutch member (218) having a plurality of downwardly facing clutch teeth (219), as shown in FIG. 9, which are compatible with the upwardly facing clutch teeth (208) of the shuttle (190). The lower clutch member (206) and the upper clutch member (218) together comprise a clutch assembly (220) of the shuttle cam assembly (176).

The outer surface (196) of the shuttle (190) extends through the internal bore (210) of the helical cam (192). The helical cam (192) is permitted to move longitudinally relative to the shuttle (190) between the upper and lower ends (198, 200) of the shuttle (190). Movement of the helical cam (192) downwards toward the lower end (200) of the shuttle (190) engages the clutch teeth (208, 220) of the lower clutch member (206) and the upper clutch member (218). Engagement of the upper and lower clutch members (218, 206) prevents the rotation of the helical cam (192) relative to the shaft (190). However, rotation of the helical cam (192) relative to the shaft (190) is permitted when the upper and lower clutch members (218, 206) are disengaged.

Further, the outer surface (212) of the helical cam (192) defines one or more helical grooves (221) therein extending substantially between the upper and lower ends (214, 216) of the helical cam (192). The adjacent inner surface (55) of the orienter housing (50) is comprised of one or more compatible keys (222) which are received within the helical grooves (221). In the preferred embodiment, four keys (222) are welded into the orienter housing (50) adjacent the first end (52). As a result, as the shuttle cam assembly (176) is moved longitudinally within the orienter housing (50), the helical cam (192) is moved helically within or rotated relative to the orienter housing (50) as the keys (222) are guided or directed within the corresponding compatible helical grooves (221).

In operation, when the orienting device (22) is actuated by the longitudinal movement of the piston (78), the friction between the shuttle cam assembly (176) and the orienter housing (50) will force the clutch teeth (208, 220) of the lower clutch member (206) and the upper clutch member (218) together. The engagement of the clutch teeth (208, 220) results in the rotation of the shaft (98) within the orienter housing (50) as the shuttle cam assembly (176) and the helical cam (192) travel longitudinally downward within the orienter housing (50) to compress the return spring (186). Thus, the actuator piston (78) powers the shuttle cam assembly (176) through the clockwise rotation (looking downhole or when viewed from above) of the shaft (98).

When the actuator (20) is in the second position, the clutch teeth (208, 220) are engaged and the key (222) in the orienter housing (50) abuts up against a taper at an uphole or upper end of the helical groove (221). Thus, the shaft (98) is prevented or inhibited from rotating in a clockwise direction (looking downhole or when viewed from above) while drilling proceeds by the downhole motor (30).

When the pumps are shut off or placed in the "pumps off" position, the spring force or compression force of the spring return (186) acts upon the shuttle (190) while the helical cam (192) holds on the inner surface (55) of the orienter housing (50) until the clutch teeth (208, 220) disengage. Once disengaged, the spring return (186) acts upon the shuttle cam assembly (176) to re-set the shuttle cam assembly (176) or return it to its starting or "pumps off" position. As the clutch teeth (208, 220) are disengaged, the shuttle (190) moves longitudinally relative to the shaft (98) to return to its starting position, while the helical cam (192) rotates relative to the shuttle (190).

The orienting device (22) is further comprised of a ratchet assembly (224) for inhibiting or preventing the shaft (98) from rotating counter-clockwise (looking downhole or when viewed from above) either during drilling or during re-setting of the shuttle cam assembly (176). The ratchet assembly (224) is comprised of an upper ratchet member (226) and a lower ratchet member (228). The upper ratchet member (226) is positioned within the annular space (106) and is fixedly or rigidly connected, mounted, attached or affixed with the ratchet housing (136). Thus, the upper ratchet member (226) remains stationary relative to the housing (136), while the shaft (98) is permitted to rotate relative to the upper ratchet member (226) and the housing (136). Further, the upper ratchet member (226) is comprised of a plurality of downwardly facing ratchet teeth (230).

The lower ratchet member (228) is also positioned within the annular space (106). However, the lower ratchet member (228) is fixedly or rigidly connected, mounted, attached or affixed with the adjacent outer surface (103) of the shaft (98), particularly the top shaft (158). In particular, one or more keys (232) preferably extend between the adjacent surfaces of the lower ratchet member (228) and the shaft (98) such that the lower ratchet member (228) is prevented or inhibited from rotating relative to the shaft (98), while a limited amount of longitudinal movement of the lower ratchet member (228) relative to the shaft (98) is permitted. Further, the lower ratchet member (228) is comprised of a plurality of upwardly facing ratchet teeth (234) compatible with the ratchet teeth (230) of the upper ratchet member (226).

The ratchet teeth (230, 234) of the upper ratchet member (226) and the lower ratchet member (228) are preferably engaged at all times. To maintain the engagement of the ratchet teeth (230, 234), the ratchet assembly (224) is further preferably comprised of a ratchet spring (236) for urging the upper and lower ratchet members (226, 228) into engagement. In the preferred embodiment, the ratchet spring (236) particularly acts upon the lower ratchet member (228) for urging the lower ratchet members (226) toward the upper ratchet member (226) such that the ratchet teeth (230, 234) are engaged.

The ratchet assembly (224), and particularly the ratchet teeth (230, 234), are shaped or configured such that rotation of the shaft (98) and the lower ratchet member (228) relative to the upper ratchet member (226) and the orienter housing (50) in a clockwise direction (looking downhole or when viewed from above) is permitted. Specifically, the ratchet teeth (230, 234) are permitted to slip or move relative to each other. However, rotation of the shaft (98) and the lower ratchet member (228) relative to the upper ratchet member (226) and the orienter housing (50) in a counter-clockwise direction (looking downhole or when viewed from above) is prevented. Specifically, the ratchet teeth (230, 234) become engaged such that movement relative to each other is prevented.

Further, the clutch assembly (220) of the shuttle cam assembly (176) and the ratchet assembly (224) are preferably designed or configured to allow the shaft (98) to rotate approximately 20° clockwise (looking downhole) as the shuttle cam assembly (176) is actuated downward by the actuator (20). The ratchet assembly (224) prevents the shaft (98) from rotating counter clockwise. Thus, the net output of the shaft (98) in one full cycle of the piston (78) and the shuttle cam assembly (176) is 20° clockwise.

In the preferred embodiment, each of the lower and upper clutch members (206, 218) has 36 clutch teeth (208, 219) that are rotationally 10° apart. For the orienting device (22) to function properly, the relative orientation of the clutch teeth (208) of the shuttle (190) must be correctly set to the orientation of the clutch teeth (219) on the helical cam (192). The process of setting this relative tooth orientation is called timing.

Further, in the preferred embodiment, the shuttle cam assembly (176) is designed or configured to rotate the shaft (98) past 20° clockwise to ensure that the shaft (98) has rotated 2 tooth clicks within the ratchet assembly (224) and then permit the shaft (98) to rotate back counter clockwise to transfer any drillstring (26) torque from the shuttle cam assembly (176) to the ratchet assembly (224). By transferring the torque to the ratchet assembly (224), the shuttle cam assembly (176) will more easily reset when the pump pressure is shut off. This extra rotation past 20° is called backlash.

As discussed previously, the lower end (102) of the shaft (98), and particularly the lower end (174) of the bottom shaft (160) extends from the second end (54) of the orienter housing (50). In the preferred embodiment, a protector sleeve (238) is mounted about the bottom shaft (160) as it exits from the orienter housing (50). Thus, the protector sleeve (238) is positioned within the annular space (106) at, adjacent or in proximity to the second end (54) of the orienter housing (50). The protector sleeve (238) is preferably fixedly or rigidly mounted, connected, attached or otherwise affixed with the outer surface (103) of the bottom shaft (160). In the preferred embodiment, a key (240) extends between the adjacent surfaces of the protector sleeve (238) and the bottom shaft (160) to prevent the rotation of the protector sleeve (238) relative to the bottom shaft (160). Further, the protector sleeve (238) is preferably maintained in position longitudinally relative to the bottom shaft (160) between an upwardly directed shoulder (242) provided by the bottom shaft (160) and a retaining ring (244).

Further, the protector sleeve (238) is preferably comprised of a wear resistant material such as carbide. As well, in the preferred embodiment, the second end (54) of the orienter housing (50) is comprised of a wear resistant insert, such as a carbide insert (246), positioned adjacent the protector sleeve (238).

Finally, the orienting device (22) is preferably fluid filled, preferably with lubricating fluid or oil, and is pressure compensated or balanced. Specifically, the annular space (106) within the orienting device (22) is filled with lubricating oil. The annular space (106) is sealed at an upper end by the inner and outer sealing assemblies (108, 92) of the piston (78) such that the lubricating oil is inhibited or prevented from passing out of the orienting device (22) past the piston (78). The annular space (106) within the orienting device (22) is sealed at a lower end by a compensation piston (248). Further, the orienter housing (50) is comprised of one or more pipe plugs (249) extending through the orienter housing (50) into the sealed annular space (106) for the introduction of the lubricating oil therein.

The compensation piston (248) may be comprised of any balance piston or floating piston movable within the annular space (106). The compensation piston (248) has an upper end (250), a lower end (252), an internal bore (254) extending between the upper and lower ends (250, 252) and an outer surface (256). The upper end (250) of the compensation piston (248) is exposed to the sealed annular space (106) and the lubricating oil therein. The lower end (252) of the compensation piston (248) is exposed to the borehole annulus pressure via one or more equalizer ports or vents (258) extending through the orienter housing (50) downhole of the compensation piston (248). When the pumps are in the "pumps on" position, the compensation piston (248) tends to move downwards or in a downhole direction towards the second end (54) of the orienter housing (50) as the piston (78) moves toward the second position. When the pumps are turned off to the "pumps off" position, the pressure between the annulus (106) and the borehole annulus is permitted to equalize, which tends to move the compensation piston (248) upwards or in an uphole direction towards the first end (52) of the orienter housing (50). Equalization of the pressure permits the actuator (20) and the orienting mechanism (42) of the orienting device (22) to be more easily or readily re-set for the next cycle.

In the preferred embodiment, the compensation piston (248) is comprised of an outer sealing assembly (260) for sealing between the outer surface (256) of the compensation piston (248) and the inner surface (55) of the orienter housing (50) Further, the compensation piston (248) is comprised of an inner sealing assembly (262) for sealing between the internal bore (254) of the compensation piston (248) and the outer surface (103) of the shaft (98). The outer and inner sealing assemblies (260, 262) may each be comprised of one or more seals or any sealing structure or device suitable for sealing between the adjacent surfaces, particularly upon the longitudinal movement of the compensation piston (248) within the annular space (106). Thus, the combination of the inner sealing assembly (262) and the outer sealing assembly (260) inhibits or prevents the passage of fluids through the annular space (106) past the compensation piston (248).

Further, in the preferred embodiment, the compensation piston (248) is further comprised of one or more outer wear rings (264) positioned about or mounted within the outer surface (256) of the compensation piston (248). Further, the compensation piston (248) is comprised of one or more inner wear rings (266) positioned about or mounted within the internal bore (254) of the compensation piston (248).

The actuator (20) of the within invention permits the orienting device (22) to be used without the need for an equalizer sub (38). However, where desired, an equalizer sub (38) may still be used and connected into the bottom hole assembly (28) downhole of the orienting device (22) of the within invention and above the downhole motor (30). The equalizer sub (38) may provide a restrictor nozzle for enhancing or facilitating the pressure drop required to power the orienting device (22). In this case, by installing the actuator piston (78), the restrictor nozzle in the equalizer sub (38) may be increased as less pressure drop is required to cycle the actuator (20) and the orienting device (22). Further, the equalizer sub (38) may provide a vent port for equalizing any differential pressure that may be trapped by the downhole motor (30) in the "pumps off" position.

The embodiments of the invention in which an exclusive property or privilege is claimed are defined as follows:

1. An actuator for an orienting device, wherein the orienting device is comprised of an orienting mechanism which is actuated by longitudinal movement, the actuator comprising:

(a) a housing having a first end and a second end;

(b) a fluid passageway extending through the housing from the first end to the second end;

(c) a longitudinally reciprocable piston positioned within and providing a first partial obstruction of the fluid passageway, for engagement with the orienting mechanism such that longitudinal movement of the piston actuates the orienting mechanism; and (d) a flow restrictor positioned within and providing a constant second partial obstruction of the fluid passageway, the flow restrictor being associated with the piston such that the first partial obstruction is longitudinally aligned with the second partial obstruction for a portion of a longitudinal range of travel of the piston to provide a combined obstruction of the fluid passageway.

2. The actuator as claimed in claim 1 wherein the combined obstruction obstructs the fluid passageway substantially completely so that a fluid is substantially blocked from moving through the fluid passageway when the first partial obstruction is aligned with the second partial obstruction.

3. The actuator as claimed in claim 1 wherein the range of travel of the piston extends between a first position of the piston and a second position of the piston and wherein the piston actuates the orienting mechanism by moving toward the second position.

4. The actuator as claimed in claim 3 wherein movement of the piston toward the second position moves the first partial obstruction out of longitudinal alignment with the second partial obstruction.

5. The actuator as claimed in claim 4 wherein the first partial obstruction is longitudinally aligned with the second partial obstruction when the piston is at the first position.

6. The actuator as claimed in claim 4 wherein the piston is comprised of an annular sleeve having an internal bore and wherein the flow restrictor is positioned within the internal bore when the first partial obstruction is aligned with the second partial obstruction.

7. The actuator as claimed in claim 6 wherein the flow restrictor is at a fixed longitudinal position in the fluid passageway.

8. An orienting device for orienting a borehole apparatus in a borehole comprising:

(a) an orienting mechanism which is actuated by longitudinal movement; and (b) an actuator for actuating the orienting mechanism, wherein the actuator is comprised of:

(i) a housing having a first end and a second end;

(ii) a fluid passageway extending through the housing from the first end to the second end;

(iii) a longitudinally reciprocable piston positioned within and providing a first partial obstruction of the fluid passageway, wherein the piston engages the orienting mechanism such that longitudinal movement of the piston actuates the orienting mechanism; and (iv) a flow restrictor positioned within and providing a constant second partial obstruction of the fluid passageway, the flow restrictor being associated with the piston such that the first partial obstruction is longitudinally aligned with the second partial obstruction for a portion of a longitudinal range of travel of the piston to provide a combined obstruction of the fluid passageway.

9. The orienting device as claimed in claim 8 wherein the combined obstruction obstructs the fluid passageway substantially completely so that a fluid is substantially blocked from moving through the fluid passageway when the first partial obstruction is aligned with the second partial obstruction.

10. The orienting device as claimed in claim 9 wherein the range of travel of the piston extends between a first position of the piston and a second position of the piston and wherein the piston actuates the orienting mechanism by moving toward the second position.

11. The orienting device as claimed in claim 10 wherein movement of the piston toward the second position moves the first partial obstruction out of longitudinal alignment with the second partial obstruction.

12. The orienting device as claimed in claim 11 wherein the first partial obstruction is longitudinally aligned with the second partial obstruction when the piston is at the first position.

13. The orienting device as claimed in claim 11 wherein the piston is comprised of an annular sleeve having an internal bore and wherein the flow restrictor is positioned within the internal bore when the first partial obstruction is aligned with the second partial obstruction.

14. The orienting device as claimed in claim 13 wherein the flow restrictor is at a fixed longitudinal position in the fluid passageway.

* * * * *

UNITED STATES PATENT AND TRADEMARK OFFICE

CERTIFICATE OF CORRECTION

PATENT NO. : 6,439,321 B1
DATED : August 27, 2002
INVENTOR(S) : Ian Gillis et al.

It is certified that error appears in the above-identified patent and that said Letters Patent is hereby corrected as shown below:

Column 21,
Line 50, delete "1" and insert -- 2 -- after "claim"

Signed and Sealed this

Twenty-fifth Day of February, 2003

JAMES E. ROGAN
*Director of the United States Patent and Trademark Office*